US006371486B1

(12) United States Patent
Yiu

(10) Patent No.: US 6,371,486 B1
(45) Date of Patent: Apr. 16, 2002

(54) HINGE MEANS FOR A DART BOARD ASSEMBLY

(76) Inventor: Chih-Hao Yiu, 7-1 Floor, No. 30, Lin-Sen Rd., Taichung City (TW)

( * ) Notice: Subject to any disclaimer, the term of this patent is extended or adjusted under 35 U.S.C. 154(b) by 0 days.

(21) Appl. No.: 09/566,498

(22) Filed: May 8, 2000

(51) Int. Cl.[7] ..... F41J 3/02; E05F 1/12
(52) U.S. Cl. ..... 273/408; 16/291
(58) Field of Search ..... 16/291–293, 297, 16/303; 273/371, 403, 404, 408

(56) References Cited

U.S. PATENT DOCUMENTS 2,702,651 A * 2/1955 Graham ..... 16/291
4,457,047 A * 7/1984 Lautenschlager ..... 16/291
4,845,810 A * 7/1989 Brown et al. ..... 16/291

* cited by examiner

*Primary Examiner*—Mark S. Graham
(74) *Attorney, Agent, or Firm*—Charles E. Baxley

(57) ABSTRACT

A dart board assembly includes a fixed member connected to a dart board and pivotally connected to a door. A spring member is connected to the fixed member and is engaged with a first plain surface on a first side of the hinge member when the door is at open position to secure the open status. The spring member is engaged with a second plain surface on a second side of the two hinge members when the door is at close position.

4 Claims, 7 Drawing Sheets

HINGE MEANS FOR A DART BOARD ASSEMBLY

FIELD OF THE INVENTION

The present invention relates to a dart board assembly having two doors wherein the hinge means connected between the doors and the dart board includes a flexible plate which alternatively engages with two plain surfaces on the hinge members at open and close position.

BACKGROUND OF THE INVENTION

A conventional dart assembly is shown in FIG. 7 and generally includes a dart board which is enclosed in a frame 10. Two doors 11 are respectively and pivotally connected to two sides of the frame 10 by two pairs of hinges 12. A magnet 14 is connected to a top of the frame 10 and each door 11 has a metal piece 13 which can be connected to the magnet 14 when the doors 11 are at close position. The doors 11 are designed to protect the dart board from being accessed by dirt or unexpected objects. Nevertheless, the doors 11 cannot be secured at their positions when the metal pieces 13 on the two doors 11 are connected to the magnet 14 because once the metal pieces 13 are separated from the magnet 14, the doors 11 are at a free status and fail to achieve the desired purpose. Actually, the force to connect the metal pieces 13 to the magnet 14 is limited so that the doors are unstable during transportation.

The present invention intends to provide a hinge means between a door and a dart board wherein a spring member is biased on one of two plain surfaces on the hinge member on the door so as to keep the door at open position or close position.

SUMMARY OF THE INVENTION

In accordance with one aspect of the present invention, there is provided a dart board assembly comprising a fixed member connected to a dart board and a door pivotally connected to the dart board. The door has a hinge member and is pivotally connected to the fixed member. A spring member is connected to the fixed member and engaged with a first side of the hinge member when the door is at open position. The spring member is movably engaged with a second side of the hinge member when the door is at close position.

The object of the present invention is to provide a dart assembly with doors wherein a spring member is engaged with the hinge members to keep the doors at open position or close position as desired.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
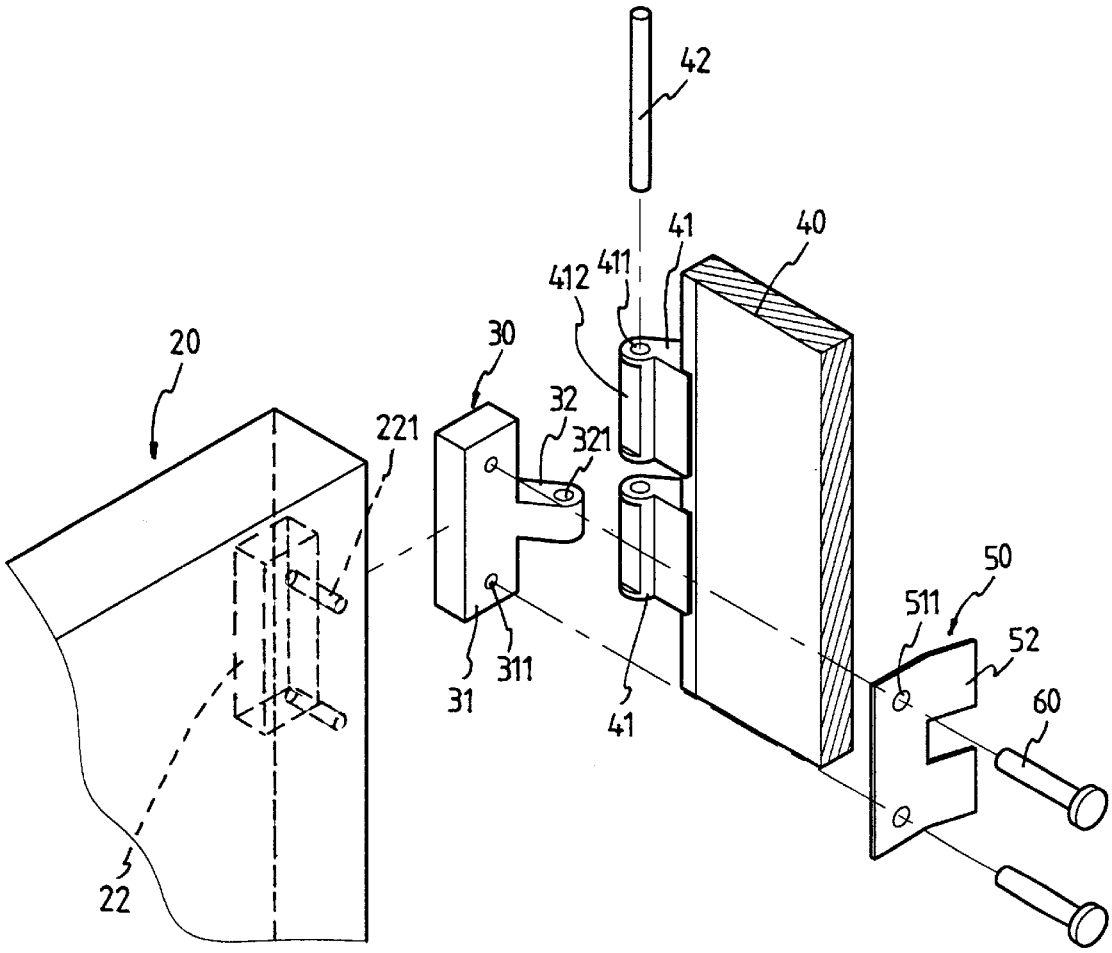
FIG. 1 is an exploded view to show a hinge means for a dart board assembly of the present invention.
Figure 2:
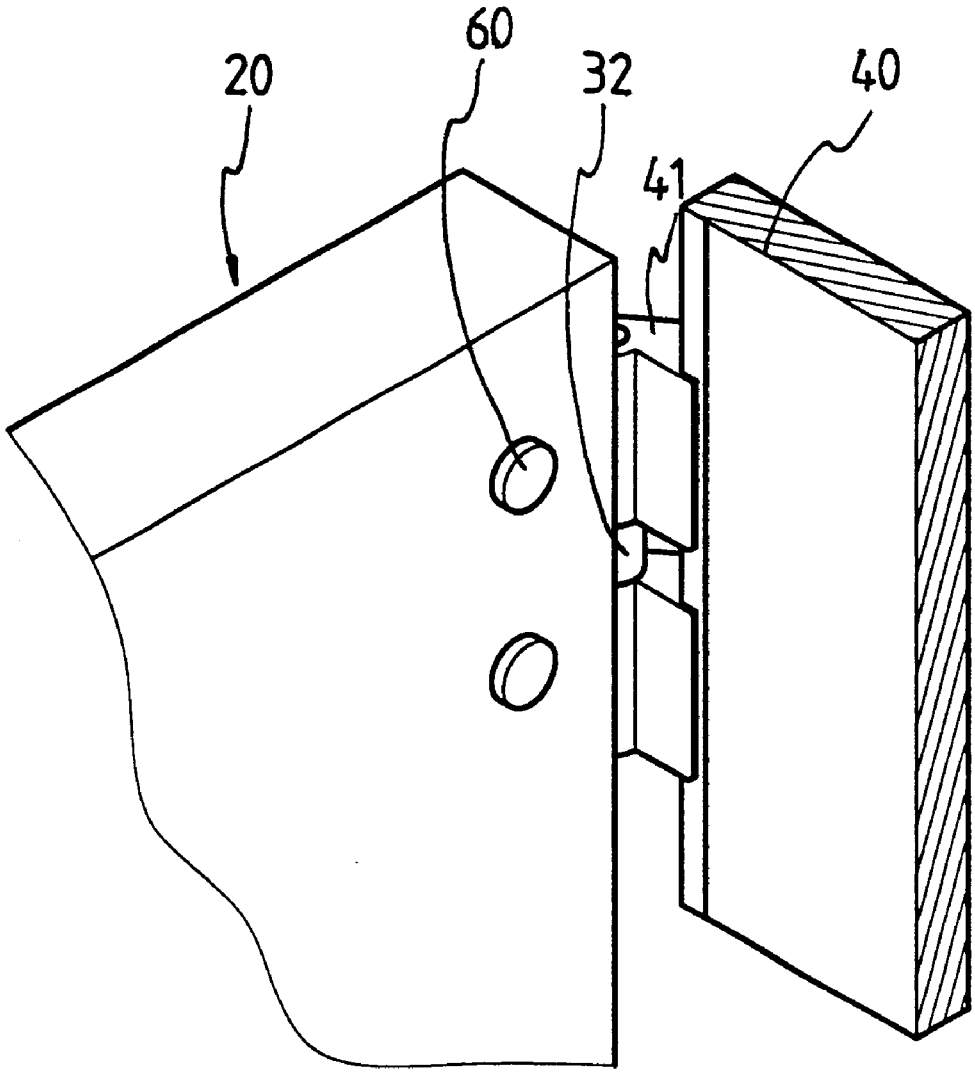
FIG. 2 is a perspective view to show a door is pivotally connected to the dart board by the hinge means of the present invention.

Referring to FIGS. 1 to 4, the dart assembly in accordance with the present invention comprises dart board 21 which is enclosed by a frame 20 and two doors 40 (only one is shown) is pivotally connected to a side of the frame 20. The frame 20 has a recess 22 defined in the side thereof and a fixed member 30 is received in the recess 22. The fixed-member includes a body 31 and a tongue 32 extending from a mediate portion of the body 31. The body 31 is received in the recess 22 and has two threaded holes 311. A spring member 50 is securely connected to the body 31 and received in the recess 22. Two bolts 60 extend through the frame 20, two holes 511 in the spring member 50 and are engaged with the threaded holes 311 in the body 31 of the fixed member 30. The tongue 32 has a hole 321 defined therethrough.

The door 40 has two hinge members 41 extending from a side of the door 40 and each hinge member 41 has a passage 411 defined therethrough so that the tongue 32 is pivotally connected between the two hinge members 41 by extending a pin 42 through the passages 411 of the two hinge members 41 and the hole 321 of the tongue 32. The spring member 50 has two extensions 52 and the tongue 32 is movably located between the two extensions 52. The extensions 52 are movably engaged with a first side of the two hinge members 41 when the door 40 is at open position, and the extensions 52 are movably engaged with a second side of the two hinge members 41 when the door 40 is at close position.

Figure 3:
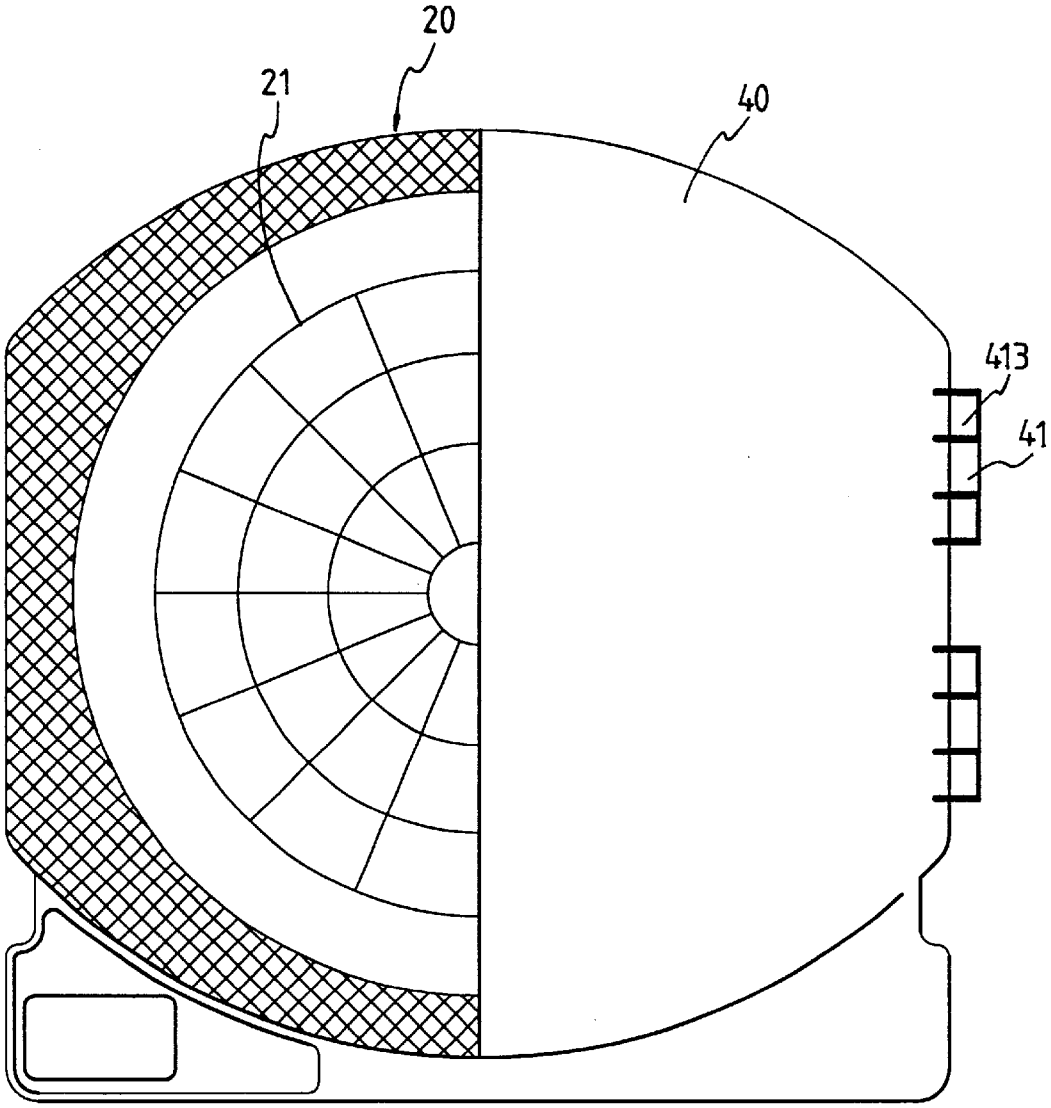
FIG. 3 is a plan view to show the hinge means when the door is at close position.
Figure 4:
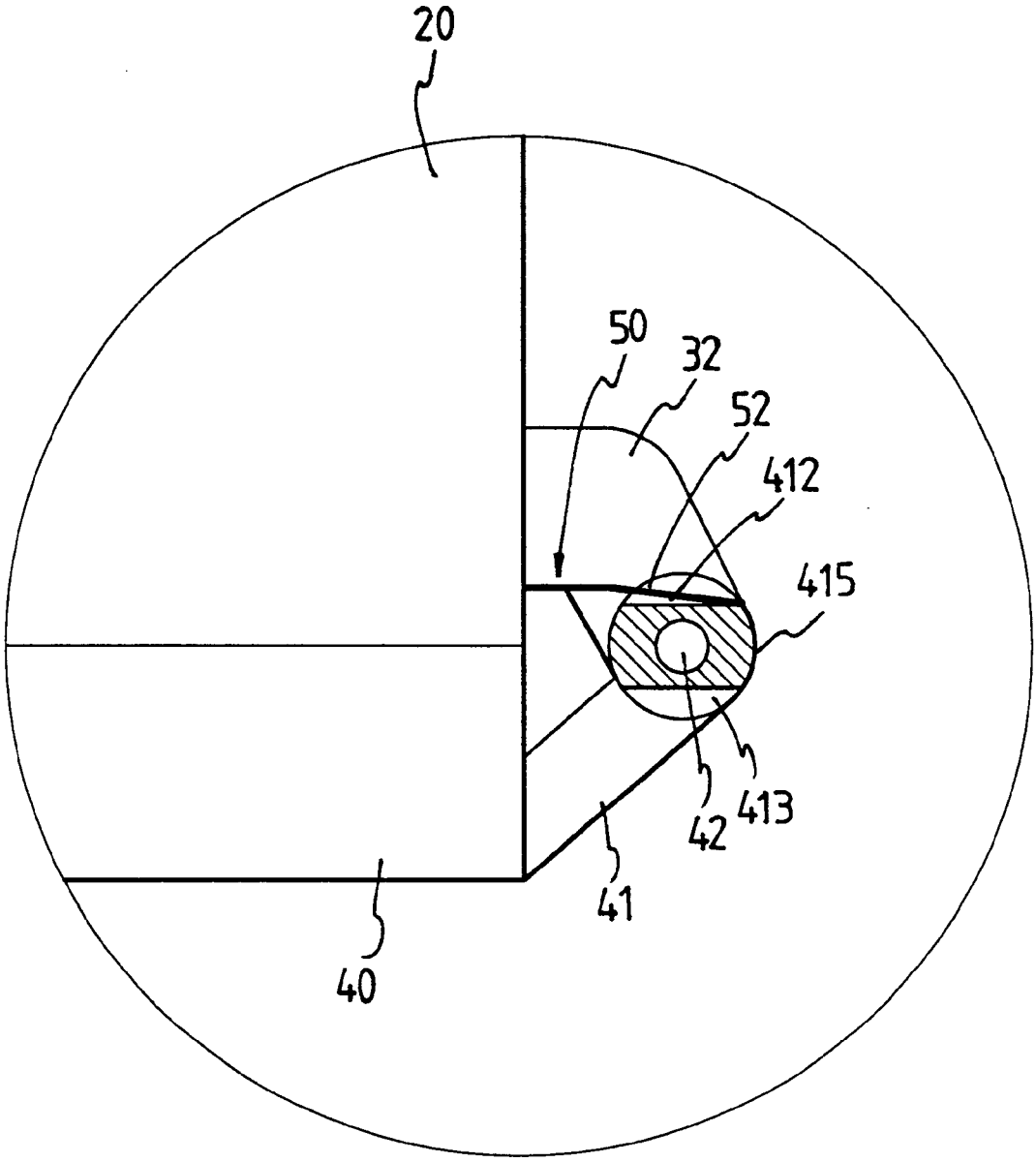
FIG. 4 is cross-sectional view to show a spring member is engaged with a first plain surface of the hinge means when the door is closed.
Figure 5:
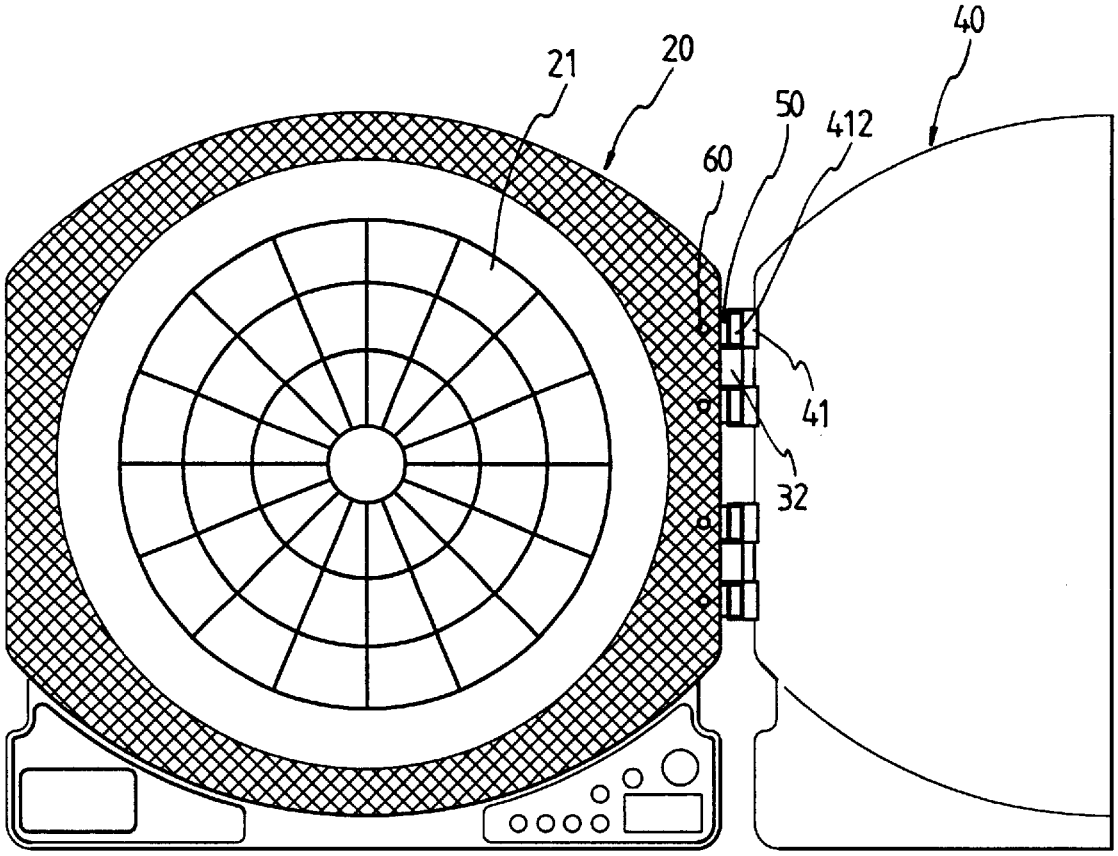
FIG. 5 is a plan view to show the hinge means when the door is at open position.
Figure 6:
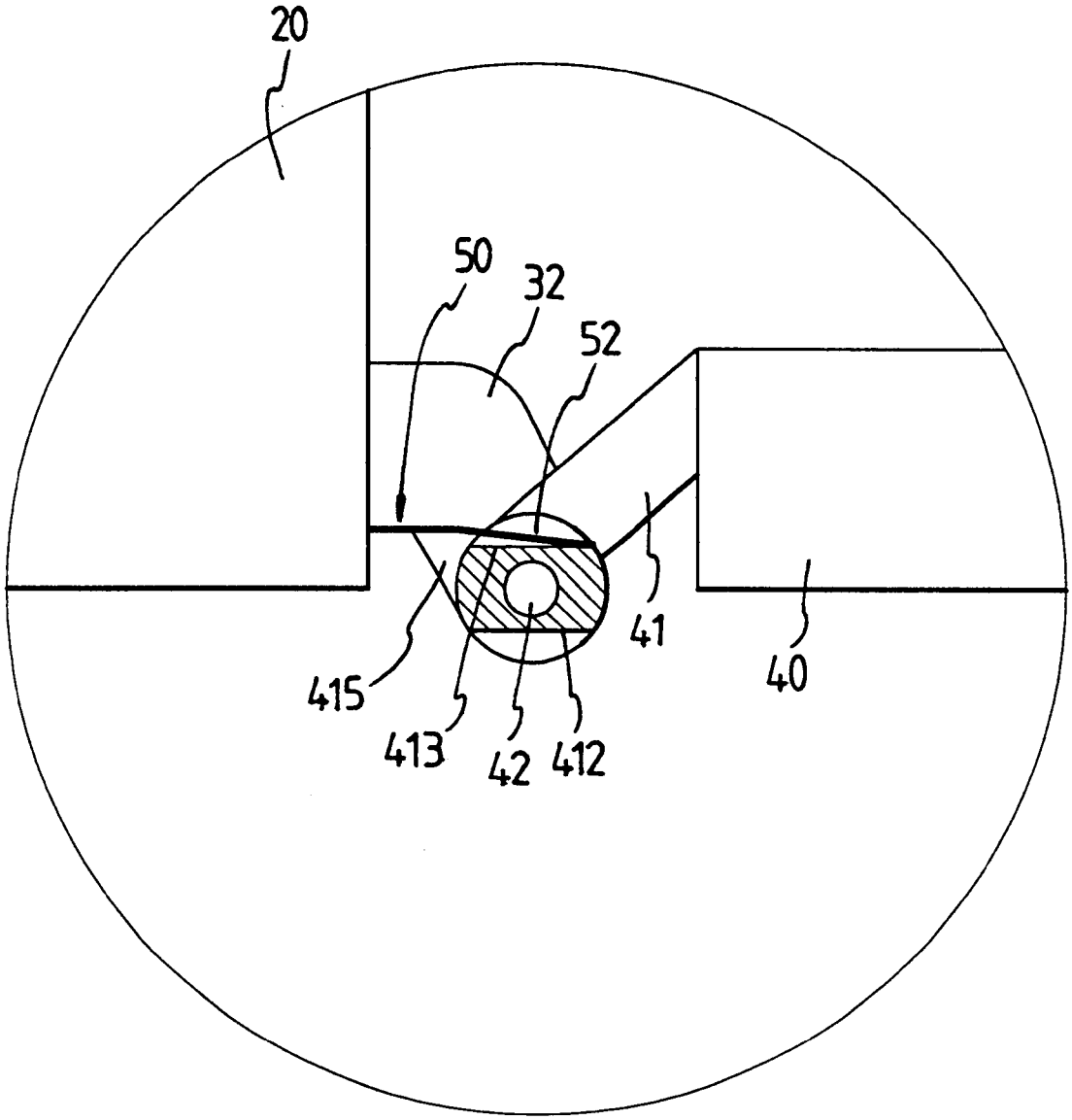
FIG. 6 is cross-sectional view to show a spring member is engaged with a second plain surface of the hinge means when the door is opened.
Figure 7:
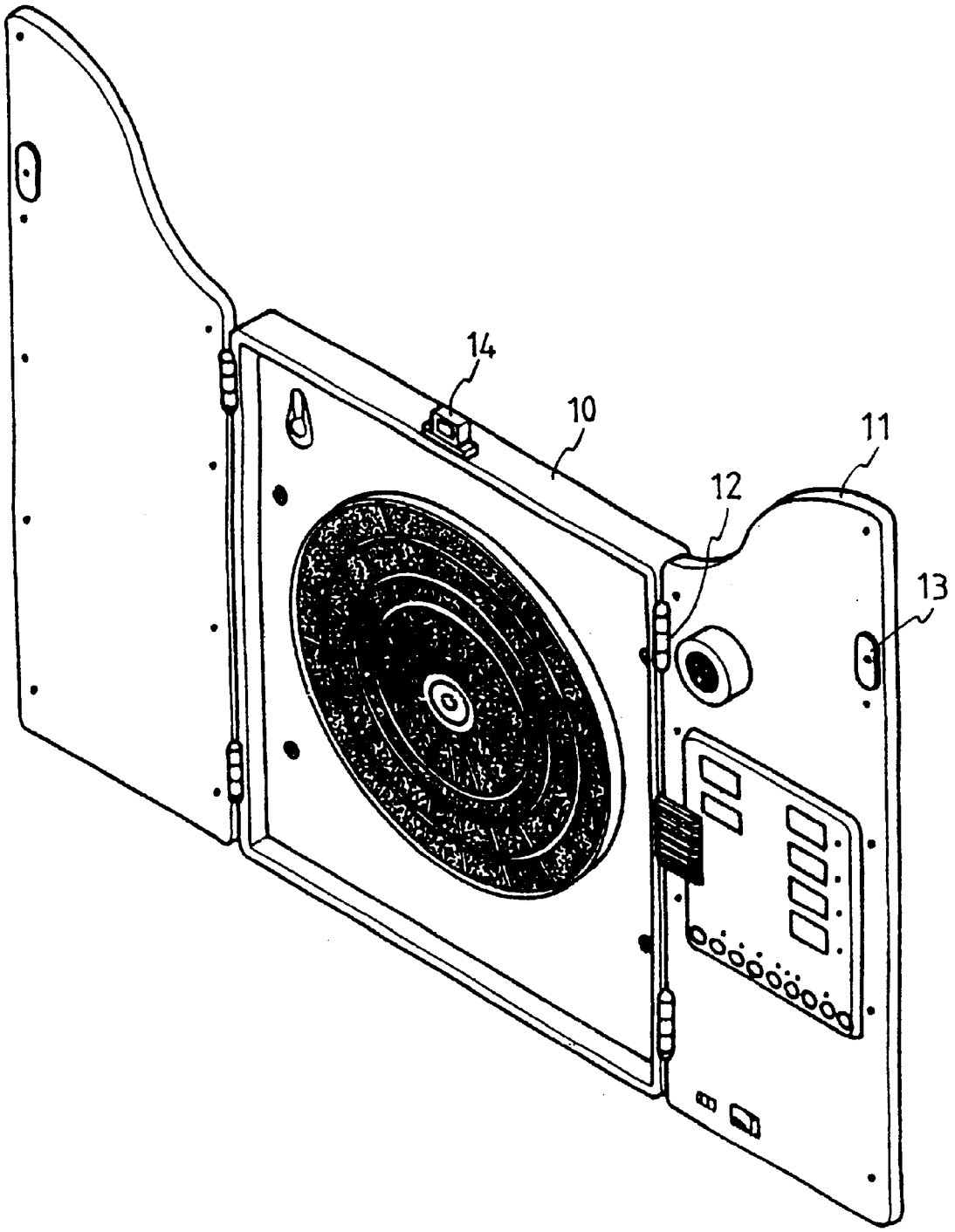
FIG. 7 PRIOR ART
FIG. 7 is a perspective view to show a conventional dart board assembly with two opened doors.

Each hinge member 41 has a first plain surface 413 on the first side thereof and the extensions 52 are engaged with the first plain surfaces 413 of the hinge members 41 as shown in FIGS. 5 and 6. The spring force of the two extensions 52 applying on the first plain surfaces 413 prevents the door 40 from being pivoted toward the dart board 21. Each hinge member 41 has a second plain surface 412 on the second side thereof and the extensions 52 are engaged with the second plain surfaces 412 of the hinge members 41 as shown in FIGS. 3 and 4. The spring force of the two extensions 52 applying on the second plain surfaces 412 prevents the door 40 from being pivoted away from the dart board 21. As shown in FIGS. 3 and 4, when closing the door 40, the hinge members 41 are rotated about the pin 42 and the two extensions 52 slide over a rounded end 415 connected between the first plain surface 413 and the second plain surface 412.

While we have shown and described various embodiments in accordance with the present invention, it should be clear to those skilled in the art that further embodiments may be made without departing from the scope and spirit of the present invention.

What is claimed is:

1. A dart board assembly comprising:

a fixed member connected to a dart board and a tongue extending from said fixed member, said tongue having a hole defined therethrough;

a door pivotally connected to said dart board and having a hinge member extending from a side of said door, said hinge member having a passage defined therethrough, said tongue of said fixed member pivotally connected to said hinge member by extending a pin through said passage of said hinge member and said hole of said tongue, said hinge member having at least one plane surface, and a spring member connected to said dart board and movably engaged with said at least one plane surface.

2. The dart board assembly as claimed in claim 1, wherein said hinge member has a first plane surface on a first side thereof and a second plane surface on a second side of said hinge member.

3. The dart board assembly as claimed in claim 2 further comprising a rounded end connected between said first plane surface and said second plane surface.

4. The dart board assembly as claimed in claim 1, wherein said dart board has a recess defined in a side thereof and said fixed member includes a body and said tongue extends from said body, said body received in said recess and having two threaded holes, said spring member securely connected to said body and received in said recess, two bolts extending through said dart board, said spring member and being engaged with said threaded holes in said body of said fixed member.

* * * * *